United States Patent [19]

Unsworth et al.

[11] 4,194,908

[45] Mar. 25, 1980

[54] MAGNESIUM ALLOYS

[76] Inventors: William Unsworth, 47 Thorn Rd., Swinton, Manchester; John F. King, 19 Brookside Crescent; Stephen L. Bradshaw, 89 Lords', Stile La., both of Lancaster, all of England

[21] Appl. No.: 890,893

[22] Filed: Mar. 28, 1978

Related U.S. Application Data

[63] Continuation of Ser. No. 751,739, Dec. 17, 1976, abandoned.

[30] Foreign Application Priority Data

Dec. 17, 1975 [GB] United Kingdom ..... 51612/75

[51] Int. Cl.[2] ..... C22C 23/00

[52] U.S. Cl. ..... 75/168 J; 148/161

[58] Field of Search ..... 75/168 R, 168 J; 148/161, 32.5

[56] References Cited

U.S. PATENT DOCUMENTS 3,039,868 6/1962 Payne et al. ..... 75/168 J

*Primary Examiner*—M. J. Andrews

*Attorney, Agent, or Firm*—Karl W. Flocks

[57] ABSTRACT

A magnesium-based alloy for casting contains at least 88% magnesium, 1.6–3.5% silver, 0.1–2.3% of rare earth metals comprising at least 60% neodymium, 0–2.3% thorium and 0.1–2.5% yttrium. When no more than 0.5% of yttrium is present the minimum amount of thorium is given by the equation $$[Th] = \frac{0.5 - [Y]}{4}.$$

Other elements may be present to improve the alloy properties.

13 Claims, No Drawings

MAGNESIUM ALLOYS

This is a continuation of application Ser. No. 751,739, filed Dec. 17, 1976, now abandoned.

This invention relates to magnesium-base alloys.

Magnesium alloys find numerous applications where light weight is essential, especially in aerospace technology. Magnesium alloys are known having good mechanical properties, particularly high yield strength, which are well maintained at elevated temperatures. Such alloys contain silver—usually 2-3% by weight—and neodymium, which may be added in the form of a mixture of rare earth metals.

British Patent Application No. 56021/74 discloses alloys which contain silver, neodymium and thorium and, optionally, yttrium; the yttrium is believed to improve the stability of the alloys' tensile properties at high temperatures (of the order of 250° C.) and also the resistance to creep. However the alloys disclosed in application No. 56021/74 containing yttrium and thorium contain at least 3% of yttrium by weight. Yttrium is an expensive material.

It has now been found that alloys suitable for casting having advantageous mechanical properties such as resistance to creep at elevated temperatures can be obtained by the addition of smaller quantities of yttrium to magnesium alloys containing silver and neodymium. When the yttrium content is less than 0.5% by weight thorium should be present also.

According to one aspect of the invention there is provided a magnesium-based alloy containing by weight (other than iron and other impurities):

| | |
|---|---|
| Mg | at least 88% |
| Ag | 1.6–3.5% |
| Rare earth metals of which at least 60% is neodymium | 0.1–2.3% |
| Th | 0–2.3% |
| Y | 0.1–2.5% |
| Zn | 0–0.5% |
| Cd | 0–1.0% |
| Li | 0–6.0% |
| Ca | 0–0.8% |
| Ga | 0–2.0% |
| In | 0–2.0% |
| Tl | 0–5.0% |
| Pb | 0–1.0% |
| Bi | 0–1.0% |
| Cu | 0–0.15% |
| Zr | 0–1.0% |
| Mn | 0–2.0% |

the amount of rare earth metals and Th together not exceeding 3.0% and when no more than 0.5% of Y is present the minimum amount of Th is defined by the equation $$[Th] = \frac{0.5 - [Y]}{4}$$

where [Th] and [Y] are the amounts % of Th and Y respectively.

The minimum quantity of thorium is such that it may be nil at yttrium contents of 0.5% or above and increases linearly to a value of 0.1% at the minimum yttrium content of 0.1% in accordance with the above equation.

It should be noted that yttrium is not classed as a rare earth metal.

According to one embodiment, when less than 1% of ytrrium is present the minimum amount of thorium is defined by the equation:

$$[Th] = \frac{1 - [Y]}{4.5}$$

In this embodiment the minimum quantity of thorium is nil at yttrium contents of 1% or above and increases linearly to a value of 0.2% at the minimum yttrium content of 0.1%.

The rare earth metals preferably comprise at least 75% by weight of neodymium. They preferably contain not more than 15% of cerium and lanthanum taken together, most preferably not more than 3%, as these elements may have a deleterious effect on the mechanical properties of the alloy. Cerium and lanthanum may with advantage be substantially absent.

Zirconium may be present in an amount of up to 1.0%, preferably at least 0.4%, for grain refining purposes. Up to 2.0% of manganese may also be present, but the maximum amount of zirconium and manganese together is limited by their mutual solubility.

Other elements soluble in magnesium may be present provided that they do not, by forming compounds, interfere with hardening treatment or depress the melting point sufficiently to prevent dissolution of the rare earth metals on heat treatment. These elements include:

| | |
|---|---|
| Zinc | 0–0.5% |
| Cadmium | 0–1.0% |
| Lithium | 0–6.0% |
| Calcium | 0–0.8% |
| Gallium | 0–2.0% |
| Indium | 0–2.0% |
| Thallium | 0–5.0% |
| Lead | 0–1.0% |
| Bismuth | 0–1.0% |
| Copper | 0–0.15% |

To obtain optimum mechanical properties the silver content is preferably 2–3%.

Heat treatment is normally required to obtain optimum mechanical properties in the cast alloy. The heat treatment generaly comprises solution heat treatment at an elevated temperature followed by quenching and ageing to achieve precipitation hardening. Solution treatment may be carried out at a temperature from 485° C. to the solidus of the alloy and ageing at from 100° C. to 275° C. Typical conditions are solution treatment at about 525° C. for about 8 hours and ageing at about 200° C. for 16 hours.

If the alloy contains above 0.1% Cu the high-temperature treatment should be preceded by treatment at a temperature not exceeding 485° C., for example 465° C., to avoid incipient melting.

Alloys according to the invention will be described in the following Examples.

EXAMPLE

Alloys having the compositions shown in the Table were prepared: alloys 1, 2 and 3 are comparative examples.

The silver was added as pure silver or a silver/magnesium alloy. The rare earth metals were added as a "mischmetal" or a magnesium/rare earth hardener alloy; in either case at least 60% by weight of the rare earth metal is neodymium and not more than 3% is lanthanum plus cerium. The thorium was added as a magnesium/thorium alloy or as pure thorium. Zirconium was added as magnesium/zirconium hardener or introduced via a reducible zirconium halide. Yttrium was added as pure yttrium or as a magnesium yttrium hardener alloy.

The cast specimens were heat treated at 525° C. for 8 hours following by quenching and ageing for 16 hours at 200° C.

The yield, and ultimate tensile strengths and elongation were measured at 250° C. according to British Standard 3688. The creep at 250° C. was measured by the method of British Standard 3500 part 3. The room temperature mechanical properties were measured in accordance with British Standard 18. The results are shown in the Table.

TABLE

| | Analysis % (remainder Mg) | | | | | Tensile Properties ($Nmm^{-2}$) Room Temperature | | | Elevated Temperature (250° C.) | | | Stress for 0.2% Creep Strain in 100 hours ($N.mm^{-2}$) |
|---|---|---|---|---|---|---|---|---|---|---|---|---|
| Ex. | Ag | Nd | Y | Th | Zr | Yield | U.T.S. | % Elong | Yield | U.T.S. | % Elong | |
| 1 | 2.5 | 2.0 | — | — | 0.6 | 205 | 266 | 4 | 122 | 160 | 30 | 28–33 |
| 2 | 2.5 | 1.0 | — | 1.0 | 0.6 | 210 | 270 | 4 | 167 | 185 | 16 | 37–42 |
| 3 | 2.5 | 2.2 | 0.32 | — | 0.6 | 214 | 274 | 4 | 157 | 173 | 18 | 36 |
| 4 | 2.5 | 2.1 | 0.34 | 0.1 | 0.6 | 216 | 272 | 3½ | 159 | 176 | 18 | 41 |
| 5 | 2.5 | 1.6 | 0.34 | 0.48 | 0.6 | 213 | 274 | 3½ | 167 | 181 | 15 | 44 |
| 6 | 2.4 | 0.44 | 0.16 | 1.28 | 0.7 | 200 | 260 | 4 | 159 | 175 | 19 | 42 |
| 7 | 2.5 | 1.22 | 0.76 | 0.82 | 0.6 | 211 | 269 | 4 | 169 | 189 | 17 | 48 |
| 8 | 2.4 | 0.96 | 1.24 | 0.80 | 0.7 | 205 | 272 | 8 | 170 | 197 | 16 | 47 |
| 9 | 2.4 | 0.98 | 2.2 | 0.88 | 0.6 | 205 | 282 | 6 | 166 | 203 | 14 | 51 |
| 10 | 2.4 | 1.53 | 2.3 | 0.45 | 0.6 | 207 | 280 | 5 | 166 | 209 | 13 | 50 |
| 11 | 2.4 | 0.67 | 2.1 | 1.64 | 0.6 | 197 | 268 | 4 | 160 | 209 | 16 | 49 |
| 12 | 2.4 | 0.72 | 1.17 | 0.39 | 0.7 | 201 | 289 | 12 | 161 | 185 | 17 | 57 |
| 13 | 2.5 | 1.0 | 2.3 | 0.43 | 0.6 | 204 | 293 | 8 | 163 | 204 | 12 | 53 |
| 14 | 2.5 | 1.04 | 0.54 | 1.13 | 0.6 | 203 | 253 | 1.5 | 166 | 185 | 17 | 46 |
| 15 | 2.47 | 0.90 | 0.28 | 1.04 | 0.68 | 212 | 265 | 4.0 | 168 | 184 | 19 | 48 |
| 16 | 2.5 | 1.0 | — | 1.0 | 0.6 | | | | 170 | 186 | 21 | 39 |

It can be seen that whereas addition of yttrium gave virtually no adverse effect on the tensile properties of the alloy it gave a notable improvement in resistance to creep.

It can be seen from Alloy 3, that the creep properties of the alloy containing less than 0.5% yttrium and no thorium were worse than for similar alloys containing thorium and yttrium.

The following generalisations may be made regarding alloys having compositions according to the invention:

(a) The addition of relatively small amounts of yttrium to magnesium alloys containing silver, neodymium and thorium is beneficial in raising creep resistance at elevated temperatures, (b) Good mechanical properties at elevated temperatures may be obtained with alloys containing yttrium plus thorium or at least 0.5 yttrium.

The yttrium may be added to the alloys of the invention as pure yttrium, but it may also be added at lower cost in the form of a mixture of yttrium and rare earth metals containing at least 60%, preferably at least 65%, of yttrium.

We claim:

1. A magnesium-based alloy consisting essentially of, by weight, other than iron and other impurities:

| | |
|---|---|
| Mg | at least 88 % |
| Ag | 1.6–3.5 % |
| Rare earth metals of which at least 60% is neodymium | 0.1–2.3 % |
| Th | 0–2.3 % |
| Y | 0.1–2.5 % |
| Zn | 0–0.5 % |
| Cd | 0–1.0 % |
| Li | 0–6.0 % |
| Ca | 0–0.8 % |
| Ga | 0–2.0 % |
| In | 0–2.0 % |
| Tl | 0–5.0 % |
| Pb | 0–1.0 % |
| Bi | 0–1.0 % |
| Cu | 0–0.15 % |
| Zr | 0–1.0 % |
| Mn | 0–0.2 % |

the amount of rare earth metals and Th together not exceeding 3.0% and when no more than 0.5% of Y is present the minimum amount of Th is defined by the equation $$\text{weight \% Th} = \frac{0.5 - \text{weight \% Y}}{4},$$

the maximum contents of Zr and Mn together being limited by their mutual solubility.

2. An alloy according to claim 1, in which the rare earth metals comprise at least 75% by weight of neodymium.

3. An alloy according to claim 1, in which the rare earth metals comprise not more than 15% by weight of lanthanum plus cerium.

4. An alloy according to claim 3 in which the rare earth metals comprise not more than 3% by weight of lanthanum plus cerium.

5. An alloy according to claim 4 in which the rare earth metals comprise substantially no lanthanum or cerium.

6. An alloy according to claim 1, in which the minimum amount of thorium is defined by the equation $$\text{weight \% } Th = \frac{1 - \text{weight \% } Y}{4.5}$$

when less than 1% of yttrium is present.

7. An alloy according to claim 1 which contains at least 0.4% by weight of zirconium.

8. An alloy according to claim 1 which contains from 2 to 3% by weight of silver.

9. An alloy according to claim 1 in which the rare earth metals comprise at least 75% by weight neodymium, and not more than 3% by weight of cerium and lanthanum taken together, the amounts of neodymium, yttrium, silver and thorium being such in relation to one another to provide said alloy with good creep resistance and good mechanical properties at elevated temperatures.

10. An alloy in accordance with claim 1 in the form of a heat treated metal article, said article having been solution heat treated at a temperature of 485° C. to the solidus of the alloy, quenched and aged at 100°-275° C.

11. A heat treated metal article in accordance with claim 10 wherein said article has been solution heat treated at a temperature of about 525° C. for about 8 hours.

12. A heat treated metal article in accordance with claim 10 wherein said alloy contains more than 0.1% by weight of copper and has been subjected to a preliminary heat treatment at a temperature not exceeding 485° C., followed by said solution heat treatment at a temperature from 485° C. to the solidus of the alloy.

13. A heat treated metal article in accordance with claim 10 wherein said article has been subjected to aging at a temperature of about 200° C. for a period of about 16 hours.

* * * * *